US006533863B2

(12) United States Patent
Robbins

(10) Patent No.: US 6,533,863 B2
(45) Date of Patent: Mar. 18, 2003

(54) GAPPED BEDPLATE FOR UNIFORM CARPET BACK COATING

(75) Inventor: Jeffrey L. Robbins, Phoenixville, PA (US)

(73) Assignee: Bayer Corporation, Pittsburgh, PA (US)

( * ) Notice: Subject to any disclaimer, the term of this patent is extended or adjusted under 35 U.S.C. 154(b) by 16 days.

(21) Appl. No.: 09/859,699

(22) Filed: May 17, 2001

(65) Prior Publication Data

US 2002/0172772 A1 Nov. 21, 2002

(51) Int. Cl.[7] ..... B05C 11/02

(52) U.S. Cl. ..... 118/500; 118/33; 118/641; 118/67; 118/68; 118/126; 118/413; 156/72

(58) Field of Search ..... 118/50.1, 641, 118/33, 67, 68, 126, 413, 500; 428/96; 156/72, 435; 427/356, 372.2

(56) References Cited

U.S. PATENT DOCUMENTS 4,357,373 A * 11/1982 Cooper ..... 427/358
4,477,495 A * 10/1984 Ring et al. ..... 427/356
4,642,086 A * 2/1987 Howarth, Jr. ..... 493/341
5,036,793 A 8/1991 Fraser ..... 118/126
6,344,254 B1 * 2/2002 Smith et al. ..... 428/95

FOREIGN PATENT DOCUMENTS

GB 377983 8/1932
GB 1121036 7/1968

* cited by examiner

*Primary Examiner*—Laura Edwards
(74) *Attorney, Agent, or Firm*—Joseph C. Gil; N. Denise Brown

(57) ABSTRACT

The present invention relates to an improved doctor blade and bedplate apparatus wherein there is a recess in the bedplate from some position upstream of the doctor blade to some position downstream of the doctor blade. This recess or gap in the area of the bedplate under the doctor blade allows one to form an even or uniform coating on the back of a web of material. This is particularly helpful in forming uniform coatings on the back of a greige good which has face fibers of varying lengths. The present invention also relates to an improved process for preparing a relatively uniform coating on the back of a web of material.

14 Claims, 3 Drawing Sheets

GAPPED BEDPLATE FOR UNIFORM CARPET BACK COATING

BACKGROUND OF THE INVENTION

The present invention relates to an apparatus comprising a bedplate and doctor blade assembly which enables the production of a uniform coating on the back of a web of material, such as, for example, on the back of an unfinished carpet, turf or textile. This is achieved by means of a recess in the bedplate from a position upstream of the doctor blade assembly to a position downstream of the doctor blade assembly over which the web of material crosses while maintaining tension on the web of material.

Doctor blade assemblies and bedplates are known to be particularly useful in the field of carpet manufacturing. Carpets are generally produced by tufting carpet yarns into a primary backing, the tufts being secured in the primary backing through use of a precoat, a foam, or a tuftbind adhesive. This carpet without a precoat of tuftbind adhesive is typically referred to as a greige good. The greige good is optionally coated with adhesive and secured to a secondary backing, generally of polypropylene or jute. Key properties of the carpeting produced by these processes are tuft bind, i.e. the strength required to pull tufts from the primary backing, and delamination strength, i.e., the force required to separate the secondary backing from the carpet.

The manufacture of carpet by implanting tufts in an adhesive composition spread on a backing material is known and described, for example, in British Patent 1,121,036, the disclosure of which is herein incorporated by reference. This requires the adhesive to be applied to a moving web of backing material in such a way as to form a uniform layer. A doctor blade, also commonly referred to as a doctor bar, is typically used to spread the adhesive or coating into a layer on the back of the greige good. In order to accommodate variations in the thickness of the greige good, backing material and/or in the desired adhesive layer, the doctor blade is mounted in an adjustable manner that allows it to be moved towards and away from a structural element (i.e., a bedplate) over which the web of material passes.

Carpets and artificial turfs are typically produced in widths about 12 to about 15 feet, but can be wide as up to about 18 feet. The manufacturing process requires that the doctor blade be about the same length as the width of the carpet, i.e., about 12 to 15 feet and possibly about 18 feet. This is necessary to enable the doctor blade to span the width of the carpet as it passes underneath the blade. The doctor blade is normally built up from one or more machined sections secured to a supporting truss or other suitable supporting means (e.g., an I beam). In order to maintain the edge of the blade accurately across the width of the web of material or greige good, the supporting truss is usually rather large, and considerable strength is required to adjust the mechanism.

U.S. Pat. No. 5,036,793 describes a doctor blade apparatus in which the adjustment means is simplified. A gap of pre-determined height is defined between the doctor blade and the bedplate to allow the web of material to pass through, and the height of this gap is adjusted by a means comprising an actuator for moving the base member (or bedplate) towards and away from the doctor blade assembly. This actuator comprises one or more jacks spaced along the base member which are preferably operable simultaneously to move the base member closer to (i.e., higher) or farther from (i.e., lower) the doctor blade assembly. Worm drive jacks connected to a common worm drive shaft are used.

Unfortunately, the apparatus of U.S. Pat. No. 5,036,793 does not allow one to produce a greige good without the same pattern that appears on the face of the greige good appearing in the coating layer that is applied to the back of the greige good.

The present invention differs from that described in U.S. Pat. No. 5,036,793 which requires that the entire bedplate is moved in relation to the doctor blade apparatus. By comparison, the present invention requires a change in the height of the bedplate from a position slightly upstream of the doctor blade to a position slightly downstream of the doctor blade such that a gap or recess is present/formed in this area. As the web of material passes over this recess, this recess allows the face fibers of the greige good to fall down into the gap or recess, thus relieving some of the pressure the face fibers put on the doctor blade, and allows the formation of a relatively uniform coating weight to be formed on the back surface of the web of material. This is particularly useful when the greige good has a pattern on the face, i.e., when the face fibers of the greige good are of varying lengths (i.e., uneven). It is also useful, when, for example, a berber carpet is being produced or for the production of artificial turf wherein the face fibers of the greige good are different lengths.

Advantages of the present invention include the fact that the present invention provides better coverage of the web of material or greige good with a thin layer of precoat, foam, tuftbind adhesive, etc., which is applied to the back surface of the web of material. The present invention allows for the production of finished carpeting articles having a relatively uniform back coating, which means that the back coating is relatively consistent in terms of the coating weight applied to the web of material. Less coating material is required by the present invention, and thereby results in cost savings in the manufacturing process.

SUMMARY OF THE INVENTION

This invention relates to an apparatus comprising a means for moving a web of material along a substantially horizontal path, a means for applying tension to the web of material as it moves along the horizontal path, a bedplate attached to a frame and positioned in a manner such that the bedplate is below at least a portion of the path and spans horizontally across the width of the path, and a doctor blade assembly attached to a frame and positioned in a manner such that the doctor blade is above the path, wherein the surface of the bedplate under the doctor blade assembly is recessed.

The present invention also relates to an improved process for the production of a finished carpet article having a uniform coating weight applied to the back surface of the greige good. This process comprises:

A) moving a greige good face side down along a substantially horizontal path;

B) applying tension to the web of material as it moves along the path;

C) applying a puddle of a frothed coating to the reverse side of the greige good through a supply means;

D) passing the greige good with the puddle through the bedplate and doctor blade apparatus described hereinabove;

E) allowing the face fibers of the greige good to fall into the recess in the bedplate; thereby F) forming a uniform coating on the back face of the fibers of the greige good; and G) collecting the back coated greige good.

DETAILED DESCRIPTION OF THE INVENTION

Figure 1:
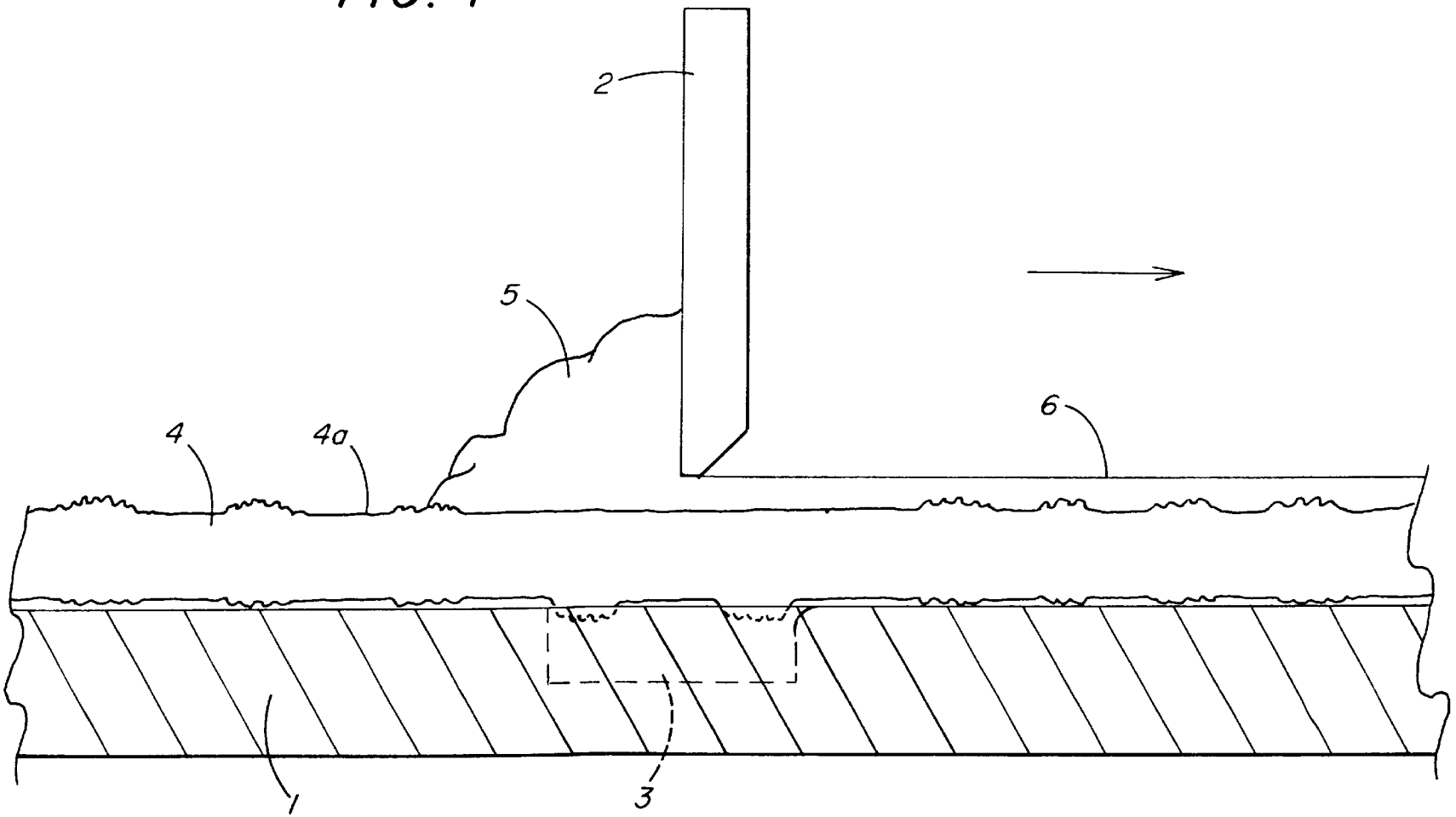
FIG. 1, a cross-sectional view of the bedplate and doctor blade assembly, represents one embodiment of the present invention wherein a portion of the uppermost surface of the bedplate under the doctor bed assembly is recessed from a position slightly upstream of the doctor blade to a position slightly downstream of the doctor blade.

As used herein, the term "coating" refers to and includes precoats, foams, scrape coats, tuftbind coatings or adhesives, and any other liquid composition applied to the back surface of a web of material, and specifically to the back surface of a greige good. The term "liquid composition" as used above means a composition capable of reacting to form a coating upon curing or cooling. The viscosity of this liquid may vary widely; however, it must be thin enough to be applied via pouring, or any other suitable means to form a puddle, and thick enough that it will not seep through to the front surface of the web of material. It will also be obvious to the skilled artisan that the reactivity (i.e., reaction rate or time to cure) of the composition will affect how high or low the viscosity can be and remain suitable for various methods of application without ruining the web of material.

By the term "uniform coating" as used in the present application, it is meant that a relatively consistent coating weight is applied across the back of the web of material (e.g., greige good). The apparatus process of the present invention prevents any pattern present in the face fibers of the web of material from being transferred to the back surface of the coating. The present invention provides a uniform coating and results in improved appearance of the back coating when compared to coating a similar web of material with a similar composition and the bedplate being free of a recess or gap in the area under the doctor blade as is presently required.

The term "greige good" as used in the present invention refers to any unfinished carpet, unfinished turf, and/or unfinished textile.

In the present invention, it has been found that by passing the web of material (e.g., the greige good) across a recess or gap in or over the bedplate as it passes under the doctor blade, that it is now possible to form a uniform coating (i.e., a coating of uniform thickness) on the back surface of a web of material such as, for example, a greige good used in producing tufted carpeting. This recess allows the face fibers to drop down, which is particularly helpful if the face fibers of the web of material or greige good are of varying lengths such as, for example, in carpeting having a pattern on the face. Since the face fibers drop down (at least partially), the weight (or amount) of the coating material applied to the back of the material web or greige good is consistently more uniform. This allows less raw material to be used in forming the coating, and enables a web of material having a relatively uniform coating weight to be produced.

In the production of carpeting having an embossed face pattern or turf having face fibers of different lengths, the usual process and conventional equipment for coating the back surface of the web of material (e.g., greige good) uses a solid bedplate which results in the face pattern being transferred to the coating in a reverse image (photo negative). Since the shorter face fibers exert less pressure against the edge of the doctor blade, a heavier coating is applied on the shorter face fibers than on the long pile fibers. The presently claimed invention allows the non-uniform face fiber greige goods to bridge a recess or gap in or on top of the (otherwise) solid bedplate. The recess or gap is located directly under the doctor blade and extends in both directions (upstream and downstream) beyond the width of the doctor blade. As the face fibers of the greige good fall into the recess, the backing is compressed evenly, thereby forming a coating of relatively uniform (or consistent) coating weight. Accordingly, the presently claimed invention allows the production of webs of material (e.g., carpeting, turf, etc.) wherein the embossed face pattern is not transposed onto (or into) the coating applied to the back of the web of material or greige good. Thus, when looking at the back of the coating, one cannot tell whether a pattern exists on the face side of the web of material.

The basic apparatus of the present invention is comparable to that known and used in coating a web of material, and preferably a greige good, in a process for the production of, for example, a carpet article. The apparatus comprises a means for moving a web of material along a substantially horizontal path; a means for applying tension to the web of material as it passes along the horizontal path; a bedplate attached to a frame and positioned such that it is below at least a portion of (preferably entirely below) the substantially horizontal path and spanning across it; and a doctor blade assembly attached to a frame and positioned in a manner such that the doctor blade is above the substantially horizontal path. It is preferred that the length of the doctor blade is the same as the width of the bedplate since the doctor blade spans the width of the web of material as it passes under the doctor blade and over the substantially horizontal path and the bedplate. The doctor blade spreads the puddle of the coating material that is applied to the back of the web of material (greige good) as the web of material passes underneath the blade. The puddle is formed upstream of the doctor blade on the reverse side of the web of material via an applicator. Suitable applicators are well known and described in the art of carpet backing.

Reference will now be made to one embodiment of the present invention as illustrated in FIG. 1, a cross-sectional view of the bedplate and doctor blade assembly. In FIG. 1, the bedplate 1 is a substantially solid substance such as, for example, steel, wherein the upper surface of the bedplate under the doctor blade assembly 2 is recessed. This recess 3 in the bedplate 1 occurs from a position slightly upstream of the doctor blade 2 to a position slightly downstream of the doctor blade 2.

Preliminary carpet operations such as correction of bowing and skewing, which do not form a part of the coating process per se, are practiced. As illustrated in FIG. 1, the web of material (e.g., a greige good) 4, is moved along by pre-tenter pins (not shown), and moves across the upper surface of the bedplate 1 with the reverse side 4*a* of the web of material 4 (e.g., greige good) facing up. A puddle 5 is applied to the reverse side 4*a* of the web of material 4. This puddle 5 is supplied by a suitable applicator (not shown). Doctor blade (or doctor bar) 2, in conjunction with bedplate 1 and recess 3, adjust the amount of the liquid composition from the puddle 5 that is being applied to the reverse side 4*a* of the web of material 4, and results in a suitable coating 6 on the reverse side of the web of material 4 downstream of the doctor blade 2 and recess 3. The doctor blade 2 and bedplate 1 assist in forcing the coating 6 into the tuft ends which are present in the reverse side 4*a* of the web of material 4.

In the embodiment illustrated in FIG. 1, the bedplate 1 has a recess 3 (i.e., gap) which begins under the web of material 4 upstream of the doctor blade 2 in the area where the puddle 5 is applied or builds up, continues under the doctor blade 2, and ends somewhere downstream of the doctor blade 2. After the web of material 4 passes under the doctor blade 2, over the recess 3 and along the remainder of the bedplate 1, it is then pulled along with tenter pins (not shown) through a suitable curing device (e.g., a curing oven) (not shown), and eventually (i.e., after cooling of the coating) the coated web of material (e.g. greige good) is collected on a roller or other suitable collecting device (not shown).

In accordance with the present invention, tension is applied to the web of material as it passes across or over the recess in the bedplate to prevent it dropping into the recess and collecting there. The pre-tenter pins (positioned upstream of the bedplate) are a particularly effective means for applying sufficient tension to the web of material to prevent the web of material 4 from collecting in the recess 3 but allowing the face fibers to drop down and relieve the pressure on the back of the web of material 4*a* as it passes under the doctor blade 2. Tenter pins (positioned downstream of the bedplate) assist in moving the web of material 4 along the path and may help improve or adjust the tension applied to the web of material 4 as it crosses the recess 3.

The recess 3 in the bedplate 1 may be formed several different ways. In general, the bedplate that is known and currently being used in commercial operations is a solid structure which typically has a rectangular shape with substantially flat upper and lower horizontal surfaces. Commercial bedplates used in the carpet and artificial turf industries are generally about 4 feet long, between about 12 and about 18 feet wide, preferably between about 12 and about 15 feet wide, and about 1 inch deep. As illustrated in FIG. 1, the bedplate 1 of the present invention may be modified such that a portion of the bedplate is "cut out" to form a gap or recess 3.

The recess under the doctor blade area allows the uneven face fibers in the web of material to drop down and relieves the pressure put on the doctor blade by these uneven face fibers as they pass under the doctor blade. By relieving the pressure on the doctor blade, the coating is applied in a more consistent and uniform manner such that the coating weight across the back surface of the web of material is relatively consistent and uniform. In other words, the present invention prevents some portions of the back surface from having a heavier coating weight while other portions of the back surface have a lighter coating weight. It is only necessary in the present invention that the shape and size of this recess be sufficient to allow the face fibers to drop down (at least partially) into the recess.

The actual shape of the recess in the bedplate to be used in accordance with the present invention is not particularly important. The recess may be in the shape of, for example, a rectangle, a square, a notch, a semi-circle, etc. The location of the recess should be such that it begins at a point in the bedplate which is slightly upstream of the doctor blade, preferably in or around the area under which the puddle of the coating composition is formed, and ends at a point in the bedplate which is slightly downstream of the doctor blade. In terms of size of the recess present in the bedplate, it is obvious that the width of the recess corresponds to the width of the bedplate and/or the width of the web of material. For example, a 12 foot wide bedplate needs a 12 foot wide recess, a 15 foot wide bedplate needs a 15 foot wide recess, etc. The length of the recess varies from about 1" to about 6", preferably from about 2" to about 5", more preferably from about 2" to about 4", and most preferably from about 2½" to about 3½". The depth of the recess should be sufficient to allow the face fibers to at least partially drop down into the recess, thereby relieving some of the pressure these face fibers (particularly the longer face fibers) put on the back of the web of material as it passes under the doctor blade. Accordingly, the depth of the recess should be at least about ½" deep, preferably between about ½" deep and 1½" deep. It is particularly preferred that the recess be at least about ½" deep and up to about 1" deep. Of course, the depth of the recess will be limited by factors such as, for example, the thickness (or depth) of the bedplate and the particular embodiment of the present invention being used as some embodiments allow for a recess of greater depth than the embodiment illustrated in FIG. 1.

The embodiment illustrated in FIG. 1 enables the manufacturer to simply replace or reposition the "cut-out" portion of the bedplate back into its original position (i.e., the location of the recess) if it is desired at some point to apply a coating to the back of a web of material without passing the web of material under the doctor blade and over a recess. This embodiment may be particularly useful for manufacturers who produce a wide variety of carpeting and artificial turf articles.

Figure 2:
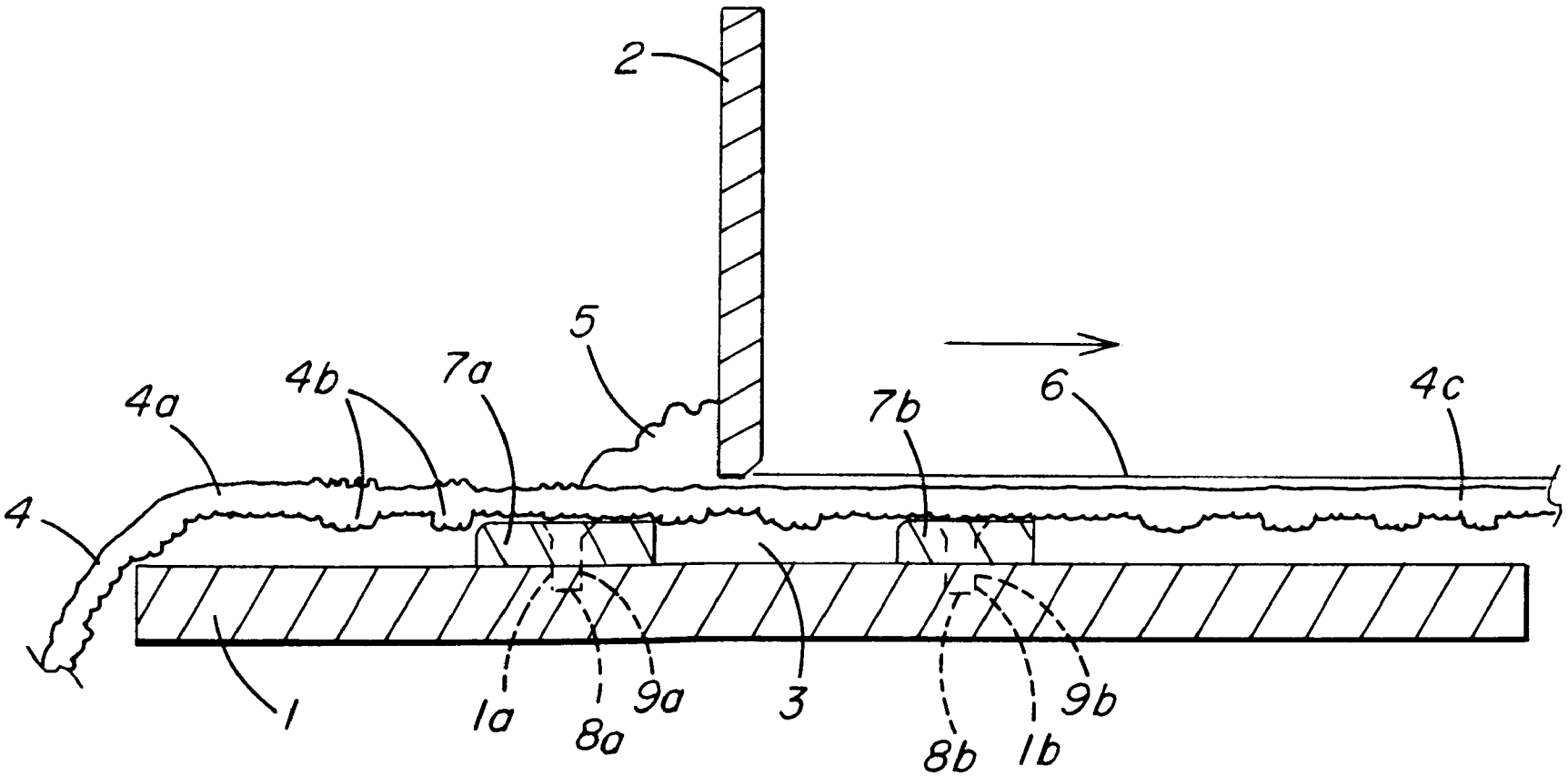
FIG. 2, a cross-sectional view of the bedplate and doctor blade assembly, illustrates another embodiment of the present invention wherein two bars are placed transversely across the upper surface of the bedplate so that these span the entire width of the bedplate, with the first bar being positioned slightly upstream of the doctor blade assembly and the second bar being positioned slightly downstream of the doctor blade assembly. These two bars combined with the upper surface of the bedplate create a recess (or gap) on top of the upper surface of the bedplate.

Reference will now be made to FIG. 2, a cross-sectional view of the bedplate and doctor blade apparatus, which illustrates another embodiment of the present invention, e.g., a commercial, one puddle polyurethane coating system. In FIG. 2, the same preliminary carpet operations such as correction of bowing and skewing, which do not form a part of the coating process per se, are practiced as briefly described above in reference to FIG. 1. To the reverse side 4*a* of the web of material 4, a polyurethane or other suitable adhesive or coating 6 is formed from puddle 5, which is applied as a liquid composition from a suitable applicator (not shown). The puddle 5 collects prior to the doctor blade 2. The doctor blade 2, in cooperation with bedplate 1, limits the applied weight of liquid composition and forces it into the reverse side 4*a* of the web of material 4.

Upstream of the doctor blade 2 is a first bar 7*a* that transversely spans across the width of the bedplate 1. The first bar 7*a* may be located in the area of the bedplate 1 slightly upstream of the doctor blade 2 and puddle 5, but close to area where the puddle 5 collects on the web of material 4. It is preferred that the first bar 7*a* is located (at least partially) underneath the area where the puddle 5 collects/forms on the reverse side 4*a* of the web of material 4, so that at least some portion of the web of material 4 which has the puddle 5 collecting on the reverse side 4*a*, has the uneven face fibers 4*b* of the web of material 4 contacting the first bar 7*a*. Downstream of the doctor blade 2 is the second bar 7*b*. The first bar 7*a* and the second bar 7*b* are attached to the bedplate 1 in FIG. 2 by countersunk bolts 8*a* and 8*b* through apertures 9*a* and 9*b* in the first and second bars 7*a* and 7*b*, and into cavities 1*a* and 1*b* in the bedplate 1. The combination of the first bar 7*a* and the second bar 7*b* with the upper surface of the bedplate 1 form a recess (or gap) 3 into which the uneven face fibers 4*b* of the web of material (e.g., greige good) 4 drop down into, thereby allowing the doctor blade 2 to adjust the amount of the material from the puddle 5 being deposited to form the coating 6 of substantially uniform coating weight across the length and width of the web of material 4. The coated web of material 4*c* passes along the remainder of the bedplate 1 before being picked up with tenter pins (not shown) which assist in moving the web of material 4 along as it passes across the recess 3. The tenter pins, located in the tenter (not shown) which is downstream of the bedplate 1, also assist the pre-tenter pins (not shown) located in the pre-tenter (not shown) which is upstream of the bedplate 1, in maintaining sufficient tension on the web of material 4 to prevent it from dropping down into the recess 3 in the bedplate 1. The tenter pins then in turn carry the coated web of material 4*c* into and through a curing oven (not shown), after which the cured web of material is cooled, and then later collected onto a suitable collection device (not shown). When the coating composition comprises a polyurethane, the web of material in the present invention is cured face side down.

In the embodiment of the present invention illustrated in FIG. 2, the first bar 7*a* forces the path of the moving web of material 4 to raise up off the upper surface of bedplate 1 slightly. The first bar 7*a* and the second bar 7*b*, in conjunction with the upper portion of the bedplate 1 located between the two bars 7*a* and 7*b*, create a recess (or gap) 3 on top of the bedplate 1, and under the doctor blade 2, over which the web of material 4 must cross, before the path of the web of material 4 drops down again after crossing the second bar 7*b* and becoming substantially horizontal to the bedplate 1.

In the embodiment illustrated in FIG. 2, the two bars 7*a* and 7*b* may be either permanently attached to the bedplate 1, or removably attached. Permanent attachment can be via welding, gluing, or other suitable means. By the phrase "removably attached" it is meant that these two bars 7*a* and 7*b* are placed on the bedplate 1 and held in place by, for example, screws, clamps, a hydraulic device, counter sunk bolts 8*a* and 8*b*, etc. as illustrated in FIG. 2. Any attachment means is suitable provided that it does not interfere with maintaining a substantially horizontal upper surface on the two bars 7*a* and 7*b* over which the web of material 4 must pass as this may effect the ability to produce a coating 6 having a uniform coating weight on the reverse side 4*a* of the web of material 4.

It is preferred that the two bars 7*a* and 7*b* are removably attached to the bedplate 1 with counter sunk bolts 8*a* and 8*b*. This also provides the manufacturer the capability of producing a coated web of material by the conventional method of passing the web of material 4 across the bedplate 1 and under the doctor blade 2, or in accordance with the present invention by passing it under the doctor blade 2 and over the recess 3 formed when the two bars 7*a* and 7*b* are attached to the bedplate 1.

It is also preferred in this embodiment of the present invention as illustrated in FIG. 2, that the leading edge of each of the two bars 7*a* and 7*b* be ground down slightly to prevent "chatter" in the web of material 4 as is crosses over these bars.

Figure 3:
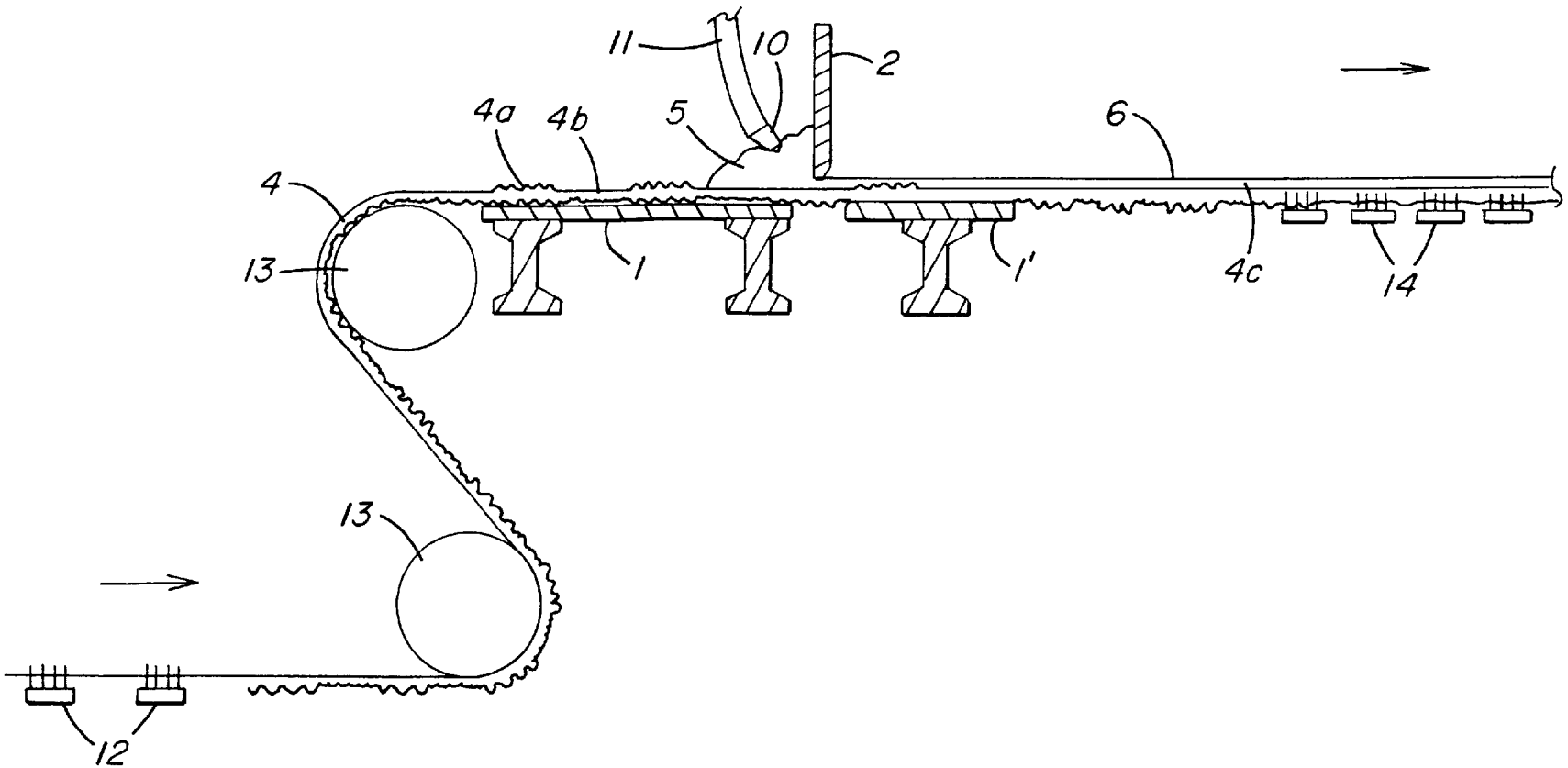
FIG. 3, a cross-sectional view of the bedplate and doctor blade assembly illustrates another embodiment of the present invention. In this embodiment, two bedplates are used along with the doctor blade assembly. These two bedplates are placed adjacent to each other, without contacting each other, and are positioned under the substantially horizontal path along which the web of material is moving. The terminal edge or vertical surface of the first bedplate and the leading edge or vertical surface of the second bedplate are spaced slightly apart to form a recess or gap under the doctor blade assembly.

Reference will now be made to FIG. 3, a cross-sectional view of the bedplate and doctor blade assembly, which illustrates another embodiment of the present invention. As described hereinabove, preliminary carpet operations such as correction of bowing and skewing, which do not form a part of the coating process per se, are practiced as briefly described above in reference to FIG. 1 and as are known and described in the art of carpet backing. Once the web of material 4 is prepared, it is moved along by pre-tenter pins 12 across one or more rollers 13 as necessary to place the web of material 4 with the uneven face fibers 4*b* facing down before the web of material 4 begins to cross the bedplate 1. To the reverse side 4*a* of the web of material (e.g., greige good) 4, a froth composition 10 is applied through supply line 11 to form a puddle 5, which builds up from the froth composition 10. Doctor blade 2, in cooperation with bedplates 1 and 1' limit the applied weight of coating composition and force it into the web of material 4 in the area under the doctor blade 2. The puddle 5 collects prior to the doctor blade 2. Upstream of the doctor blade 2 is the terminal edge of the first bedplate 1 and downstream of the doctor blade is the leading edge of the second bedplate 1'. The first bedplate 1 is located (at least partially) underneath the area where the puddle 5 collects on the reverse side 4*a* of the web of material 4, so that at least some portion of the web of material 4 which has the puddle 5 collecting on the reverse side 4*a* of it, has uneven face fibers 4*b* contacting the upper surface of the first bedplate 1. The first and second bedplates 1 and 1' are located adjacent to each other without the edges touching so as to form a recess (or gap) 3 between the terminal edge of the first bedplate 1 and the leading edge of the second bedplate 1' into which the uneven face fibers 4*b* of the web of material (e.g., greige good) 4 may fall, thereby allowing the doctor blade 2 to adjust the thickness of the deposited composition to form a coating 6 which is substantially uniform and consistent in terms of coating weight applied. The coated web of material 4*c* passes along the upper surface of the second bedplate 1' before being picked up with tenter pins 14 which assist in moving the web of material 4 across the recess between the two bedplates 1 and 1', and in conjunction with pre-tenter pins 12 assist in maintaining the tension on the web of material 4 as it passes over the recess 3. The tenter pins 14 carry the web of material 4 into and through the curing oven (not shown), after which the cured and cooled web of material is collected onto a suitable collection device (not shown). The coated web of material 4*c* in the present invention is cured face side down when the coating composition is a polyurethane composition.

The apparatus of the present invention requires a means for applying tension to the web of material as it passes over the recessed portion of the bedplate and under the doctor blade assembly. It is necessary that a sufficient amount of tension be applied and maintained to the web of material to prevent the web of material from dropping into the recess and collecting there. In general, the speed of the lines with the pretenter pins and the tenter pins are constant with each other. If sufficient tension can not be created, applied and/or maintained on the web of material, a braking device can also be applied to one or more rollers 13 of FIG. 3. The presence of this braking device keeps the roller from rolling and forces the web of material 4 to be dragged across the roller 13. Of course, other ways or methods of applying and maintaining tension to the web of material are readily apparent to one of ordinary skill in the art.

Suitable liquid compositions for forming the froth composition and coating on the back of the web of material are well known in the art of carpet backing and artificial turf production. These may be latex, polyurethane, acrylic, vinyl, etc., and may be present in the form of a scrape coat, a precoat, a foam, etc.

In addition, the present invention relates to a process for the production of a finished carpet article having a uniform carpet back coating. This process comprises:

A) moving the web of material (preferably a greige good) face side down along a substantially horizontal path;

B) applying tension to the web of material as it moves along the path;

C) applying a puddle of a frothed (preferably a polyurethane) coating to the reverse side of the web of material (preferably a greige good) through a supply means;

D) passing the web of material (preferably a greige good) with the puddle across the recess in or over the bedplate and under the doctor blade apparatus as described hereinabove;

E) allowing the face fibers of the web of material (preferably a greige good) to fall into the recess in/on the bedplate;

F) forming a uniform coating on the back face of the fibers of the web of material (preferably a greige good); and G) collecting the back coated web of material (preferably a greige good).

In the process of the present invention, it is preferred that pre-tenters and tenters are used to move the web of material. Rollers are typically used to change the direction of the face fibers of the web of material. Pre-tenter pins and tenter-pins are preferred to apply and maintain the tension on the web of material as it passes over/across the recess under the doctor blade. It is also possible to use a braking device or other suitable slowing device on the roller to slow or stop the roller from turning, thereby causing the web of material to be dragged across the roller before contacting the bedplate. Puddles of frothed material may comprise polyurethane, latex, acrylic, vinyl, and any other suitable coating or adhesive known and useful in producing carpets. Supply means for the material can be hoses, lines, etc. and these may be fixed or they may traverse across the bedplate and the web of material to deposit the liquid coating composition on the reverse side of the web of material.

It is preferred that the coated web of material is carried by tenter pins after passing over the recess, under the doctor blade, and over the rest of the bedplate (or over the second bedplate) before entering into the curing oven. Curing of the coating composition applied to the reverse surface of the web of material, as well as cooling and collecting of the cured coated web of material in the present invention are generally the same as in a conventional carpet or turf production process. The collected and cured coated web of material is then stored until ready for further use.

In the present invention, it is particularly preferred that a greige good be used as the web of material. The present invention is particularly useful for greige goods of berber carpeting, and for artificial turf greige goods. It is also useful for any other carpeting/turf manufacturing process in which the face fibers are uneven and create a pattern in the coating composition as it is applied to the back or reverse side of the web of material. The present invention allows one to produce a coated web of material or coated greige good in which the exterior surface of the coating is uniform and smooth.

The term "finished carpet article" as used in the present invention refers to any carpet product comprising a greige good and a back coating of some sort (i.e., scrape coat, precoat, foam, etc.). Carpet products include, but are not limited to artificial turf articles, and to various indoor/outdoor carpet articles such as, for example berber carpets.

The following examples further illustrate details for the process of this invention. The invention, which is set forth in the foregoing disclosure, is not to be limited either in spirit or scope by these examples. Those skilled in the art will readily understand that known variations of the conditions of the following procedures can be used. Unless otherwise noted, all temperatures are degrees Celsius and all parts and percentages are parts by weight and percentages by weight, respectively.

EXAMPLES

This process was run on a 12 foot wide coating line with a solid bedplate. Two steel bars measuring 1 inch high, 4 inches long, and 12 feet wide were attached to the top of a 12 foot wide bedplate with counter sunk bolts. These bolts were evenly spaced across the width of the bars, with one bolt placed every 12 inches, to maintain a level surface on the bars from side to side. The back edge of the first bar was located about 1.5 inches upstream from the doctor blade, and the forward edge of the second bar was located about 1 inch downstream of the doctor blade. These two bars, in conjunction with the upper surface of the bedplate, created a recess about 2.5 inches in length, about 1 inch deep and 12 feet wide, under the doctor blade. A polyurethane foam coating was applied to the back surface of a berber carpet greige good which was moving at a line speed of about 16 feet per minute. The foam coated berber carpet greige good was pulled across the recess and under the doctor blade, thereby forming a uniform gauge of 3 mm, without the face pattern of the berber carpet greige good being transferred to the foam backing.

A comparison was run using virtually the same equipment as above except that the two bars attached to the top of the bedplate were not present. The upper surface of the bedplate was substantially horizontal with no recess in the area of the doctor blade. Applying the same polyurethane foam coating to the reverse side of the same type of greige good, the gauge varied across the foam from 2 mm to 4 mm, and the face pattern from the greige good was transferred to the foam surface.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. An apparatus comprising a means for moving a web of material along a substantially horizontal path; a means for applying tension on the web of material as it passes along the substantially horizontal path; a bedplate with a substantially horizontal upper surface, said bedplate being supported by a frame and positioned in a manner such that the bedplate is below said path and spans across it; and a doctor blade assembly attached to a frame and positioned in a manner such that the doctor blade is above said path; wherein two bars are attached to the substantially horizontal upper surface of the bedplate in a manner such that the bars transversely span across the bedplate, with the first bar positioned upstream of the doctor blade and the second bar positioned downstream of the doctor blade.

2. The apparatus of claim 1, wherein the bars are permanently attached to said bedplate.

3. The apparatus of claim 1, wherein the bars are removably attached to said bedplate.

4. The apparatus of claim 3, wherein the bars are removably attached via countersunk bolts.

5. The apparatus of claim 4, wherein the counter sunk bolts are located at intervals of from 6 to 24 inches across the length of the bars.

6. The apparatus of claim 1, wherein the means for moving a web of material along a substantially horizontal path is selected from the group consisting of a pre-tenter, a tenter, and a combination of a pre-tenter and a tenter.

7. The apparatus of claim 1, wherein the means for applying tension to the web of material comprises pre-tenter pins and/or tenter pins which are present in a pre-tenter and/or a tenter, respectively.

8. The apparatus of claim 1, wherein the means for applying tension to the web of material comprises a braking means on a roller over which the web of material must pass prior to moving along the substantially horizontal path above the bedplate.

9. The apparatus of claim 1, wherein the web of material comprises a greige good.

10. The apparatus of claim 1, additionally comprising an oven positioned downstream of the doctor blade.

11. The apparatus of claim 10, additionally comprising a means for collecting the web of material after it passes through the oven.

12. The apparatus of claim 1, wherein the web of material comprises a greige good with its face surface facing down as it moves along the path, above the bedplate, across the recess, and under the doctor blade.

13. The apparatus of claim 12, additionally comprising a means for applying a coating composition to the reverse side of the greige good in a manner which forms a puddle of coating composition upstream of the doctor blade prior to the greige good passing under the doctor blade.

14. The apparatus of claim 13, additionally comprising a means for curing the coating composition applied to the back of the greige good after it has passed under the doctor blade.

* * * * *